US005524550A

United States Patent [19]

Richter et al.

[11] Patent Number: 5,524,550

[45] Date of Patent: Jun. 11, 1996

[54] BOGIES FOR RAIL VEHICLES

[75] Inventors: Wolfgang-Dieter Richter, Winkelhaid; Ulrich Hachmann, Pyrbaum; Peter Frahm, Munich, all of Germany

[73] Assignee: MAN GHH Schienenverkehrstechnik GmbH, Nuremberg, Germany

[21] Appl. No.: 287,151

[22] Filed: Aug. 8, 1994

Related U.S. Application Data

[63] Continuation-in-part of Ser. No. 71,180, Jun. 2, 1993, Pat. No. 5,335,602, which is a continuation of Ser. No. 842,052, Feb. 26, 1992, abandoned.

[30] Foreign Application Priority Data

Feb. 27, 1991 [DE] Germany ..... 4106070.9

[51] Int. Cl.[6] ..... B61F 5/00

[52] U.S. Cl. ..... 105/167; 105/199.1

[58] Field of Search ..... 105/167, 168, 105/199.1, 133, 136, 138, 165, 174, 182.1

[56] References Cited

U.S. PATENT DOCUMENTS

| | | | |
|---|---|---|---|
| 4,167,906 | 9/1979 | Steinmann et al. | 105/168 |
| 4,173,933 | 11/1979 | Kayserling | 105/182.1 |
| 4,337,706 | 7/1982 | Loosli | 105/199.1 |
| 4,411,202 | 10/1983 | Kreissig | 105/199.1 |
| 4,787,318 | 11/1988 | Vogel | 105/167 |
| 4,982,671 | 1/1991 | Chollet et al. | 105/168 |
| 5,123,358 | 6/1992 | Kemppainen et al. | 105/167 |
| 5,205,220 | 4/1993 | Wallace | 105/167 |

FOREIGN PATENT DOCUMENTS

| | | | |
|---|---|---|---|
| 0399345 | 11/1990 | European Pat. Off. | 105/167 |
| 0420801 | 4/1991 | European Pat. Off. | 105/167 |
| 2709967 | 8/1978 | Germany | 105/168 |
| 4243661 | 8/1992 | Japan | 105/168 |
| 3817725 | 10/1964 | Switzerland | 105/199.1 |
| 1743958 | 6/1992 | U.S.S.R. | 105/182.1 |
| 1116012 | 6/1968 | United Kingdom | 105/199.1 |
| 2132712 | 7/1984 | United Kingdom | 105/182.1 |

*Primary Examiner*—Mark T. Le

*Attorney, Agent, or Firm*—Mark A. Catan; Thomas R. Morrison

[57] ABSTRACT

A bogie for rail vehicles, in particular a driven bogie, with a bogie frame, includes two or more wheelset units each of which comprises at least one drive unit and/or brake unit. The wheeset units are connected with the bogie frame via a primary suspension. A secondary suspension connects a vehicle body with the bogie frame. A rigid connecting link extends from at least one of the wheelset units for connecting the bogie to the vehicle body. The rigid connecting link is coupled to the wheelset unit at its virtual center of rotation. Where practical, the center of rotation and the center of mass are coincident to minimize the moment of inertia of the wheelset units.

33 Claims, 7 Drawing Sheets

BOGIES FOR RAIL VEHICLES

This application is a continuation-in-part of Ser. No. 08/071,180, filed Jun. 2, 1993, and now U.S. Pat. No. 5,335,602, which was in turn a continuation of Ser. No. 07/842,052, filed Feb. 26, 1992, and now abandoned.

FIELD OF THE INVENTION

The present invention relates to bogies for rail vehicles. The invention is especially applicable to driven bogies. These driven bogies comprise a bogie frame, typically comprising longitudinal and lateral beams; two or more wheelset units, which may include a drive unit and/or brake unit, connected to the bogie frame via a primary suspension, or a linkage and a primary suspension; and a secondary suspension, or a center pin or similar device and a secondary suspension, for connecting the bogie frame to a car body.

For such bogies, it is desirable that the wheelsets adjust themselves on a curved track. How readily they do so depends on the longitudinal stiffness of the primary wheelset linkage or suspension. A large number of such bogies with radially adjustable wheelsets have been disclosed. With the majority of these bogies, as disclosed, for example, in German patent specifications DE 31 19 164 C2 and DE 32 32 289 A1 and WIPO patent specification WO 90/02068, which are incorporated herein by reference, more or less rigidly linked coupling mechanisms are used. These coupling mechanisms are arranged between the wheelsets or between the wheelsets and the car body. The mechanical coupling of a wheelset to a drive unit, which—because the coupling elements are so arranged—allows the wheelset to swivel about a pivoting point, is also known. This pivoting point can be ideal or real, and it can be situated before or behind the wheelset, "before" and "behind" being defined with respect to the direction of travel. Also, indirect mutual support of axle drives in conjunction with wheelset coupling elements is disclosed in European patent application 0 072 535 A1, incorporated herein by reference.

Because they are made up of many components, these known bogies are costly to assemble and to maintain, and they require close tolerances.

The wheelsets of some bogies can be more or less freely adjusted, because their primary linkage has very low longitudinal stiffness. However, since the primary linkage must also transfer the tractional forces during starting and braking, the forces adjusting the wheelset are interfered with or compensated for. The resulting parallel displacement of the wheelset must be limited because of the inherent geometry of the drive and the brake. This approach also results in limiting the mutually opposed longitudinal travels of the primary linkage required for wheelset adjustment.

When wheelsets are driven by drive motors or power takeoffs suspended from the car body, via a drive shaft and axle drive, a turn-out movement of the bogie requires the drive shaft, which is arranged between the vehicle body and the bogie, to change its length (EP 0 072 535).

When drive momentum is transferred during an inward or outward curve, a change in length requires extension forces. These extension forces can increase the turn-out resistance of the bogie several times and—especially at high rates of drive performance—hamper or make impossible the free adjustment of the bogie in the curve.

OBJECT AND SUMMARY OF THE INVENTION

It is therefore an object of the present invention to eliminate or at least mitigate the foregoing deficiencies and create an improved bogie, in particular, a traction bogie.

Briefly, a bogie for rail vehicles, in particular a driven bogie, with a bogie frame, includes two or more wheelset units which comprise at least one drive unit and/or brake unit. The wheelset units are connected to the bogie frame by a primary suspension. A secondary suspension connects a vehicle body with the bogie frame. A rigid connecting link extends from at least one of the wheelset units to connect the bogie to the vehicle body. The rigid connecting link is coupled to the wheelset unit at its virtual center of rotation. Where practical, the center of rotation and the center of mass coincide, to minimize the moment of inertia of the wheelset units.

According to the present invention a bogie for rail vehicles comprises a bogie frame, two or more wheelset units, at least one of the wheelset units comprising at least one of a drive unit, a brake unit, and a wheelset coupling frame connected thereto, a primary suspension connecting the wheelset units to the bogie frame, a secondary suspension for connecting a vehicle body to the bogie frame, and a rigid guide rod for coupling between the bogie and a vehicle body, the guide rod being coupled at its one end to one of the wheelset unit's components at, or as close as possible to, a center of rotation or virtual center of rotation thereof.

Such coupling at, or as close as possible to, the center of rotation or virtual center of rotation of the wheelset or drive unit helps to reduce or eliminate parasitic moments when traction forces are applied as the vehicle travels around a curve. Such parasitic moments lead to maladjustment of the wheelsets. Such maladjustment in turn leads to higher frictional losses and lower stability at high speed. Parasitic moments are reduced or eliminated because the coupling through which traction forces are applied generates no moment in the wheelset, leaving the wheelset free to accomodate easily to the curve of the track.

Ideally, the center of rotation should coincide with a vertical axis passing through the center of mass of the wheelset. Such an arrangement minimizes the moment of inertia about the center of rotation for a given distribution of mass in the wheelset. Minimizing the center of mass about the center of rotation permits the wheelset unit to adjust as quickly as possible to changes in track curvature. Such responsiveness also reduces frictional losses between the wheels and the track and enhances stability.

Advantageously, in embodiments of the invention, the transmission of the traction forces is such that the wheelsets are allowed only a certain adjustment behavior. This behavior is determined by forces arising from the interaction of the wheels with the track. The bogie frame is left to perform only "carrying" and "guiding" functions. Advantages of bogies embodying the present invention include ease of assembly and maintenance and loose tolerances in manufacturing.

It is advantageous to have the guide rod flexibly mounted in non-wearing elastomeric elements capable of withstanding cardanic stress, so that the longitudinal forces can be transferred without being controlled.

In the case of non-driven wheelsets, coupling can be established via a centrally arranged bearing or via a bifurcated shaft coupled to the wheelset bearings. In the case of driven wheelsets, the guide rod can be coupled close to the centre of gravity of a drive unit elastically or rigidly connected to the wheelset.

Coupling of the wheelsets can be established individually or in such a way that both wheelsets are coupled to each other inside the bogie, and a common coupling is made via the guide rod to the vehicle body. In this case, two wheelsets, for example, can be coupled in such a way that the adjustment behavior of the individual wheelsets is not affected, or a specific radial adjustment of both wheelsets, e.g., via a common central linkage point, can be achieved.

Embodiments of the invention make it possible to neutralize the traction moments that occur during starting or braking, especially in bogies where axle suspension motors or drives are elastically supported on both sides of the wheel or on the wheelset shaft. To ensure that the turning movements of the wheelsets are not interfered with by the rigidly or transversely elastically mounted drive or brake units, the latter are advantageously suspended from the main cross beam of the bogie via pendulums.

Some embodiments of the invention link at least two wheelsets and transmit traction forces via a common coupling. In such embodiments, a sufficiently soft design of the lateral characteristic of the common coupling and of the primary wheelset linkage allows the wheelsets to yield individually, as when evading lateral disturbances, without transferring the forces generated between the wheelsets.

If the arrangement of a single central coupling point in conjunction with the longitudinal stiffness of the linkage at the wheelset bearing is not enough to achieve a higher speed through stable travel, paired coupling points or elements can permit the wheelsets to turn independently. The maximum speed can be further increased, according to the present invention, by combining a coupling frame which connects all wheelset bearings at defined rates of elasticity and which facilitates the use of fully elastic quill drives.

In the case of vehicles driven by a drive shaft and an axle drive, the coupling is arranged parallel to the drive shaft, with the guide rod having the same length as the drive shaft between the universal joint centers. This arrangement eliminates any change in length during outward-turning of the bogie. It is practical to integrate the momental support required at the axle drive into a bifurcated guide rod. The guide rod connecting two adjacent axle drives may be designed similarly.

According to an embodiment of the present invention, a bogie tier a rail vehicle comprises: a bogie frame having a center, wheelset units, at least one of the wheelset units having one of a drive unit and a brake unit, a primary suspension for connecting the wheelset units to the bogie frame, the rail vehicle having a body, a secondary suspension for connecting the body to the bogie frame, a rigid member having a first end and a second end, the first end having first means for coupling the rigid member to the body, each of the wheelset units having a console extending horizontally toward the center, the second end having second means for coupling the rigid member to at least one of the consoles, and means for interconnecting at least two of the consoles.

According to another embodiment of the present invention, a bogie for a rail vehicle comprises: a bogie frame having a center, wheelset units, a coupling frame positioned substantially between two of the wheelset units, the coupling frame including means for mechanically coupling the two wheelset units, the means for mechanically coupling including means for transmitting tractional forces between the two wheelset units, a primary suspension for connecting the wheelset units to the bogie frame, the rail vehicle having a body, a secondary suspension connecting the body to the bogie frame, a rigid member having a first end and a second end, the first end having first means for coupling for joining the rigid member to the vehicle body and the second end of the rigid member having second means for coupling for joining the rigid member to the coupling frame.

According to yet another an embodiment of the present invention, a bogie for a rail vehicle comprises: a bogie frame having a center; wheelset units; at least one of the wheelset units including one of a drive unit and a brake unit; a primary suspension for connecting the wheelset units to the bogie frame; the rail vehicle having a body; a secondary suspension for connecting the body to the bogie frame; a rigid member having first, second, and third positions thereon; each of the wheelset units having a console extending horizontally toward the center; means for cardanically interconnecting at least two of the consoles; first means for coupling for coupling the rigid member to the body at the first position; second means for coupling for coupling the rigid member to the one of a drive unit and a brake unit at the second position; and third means for coupling for coupling the rigid member to one of the at least two consoles.

According to yet another embodiment of the present invention, a bogie for a rail vehicle comprises: a bogie frame having a center, wheelset units, at least one of the wheelset units including one of a drive unit and a brake unit, the one of a drive unit and a brake unit having a virtual pivot axis, a primary suspension for connecting the wheelset units to the bogie frame, the rail vehicle having a body, a secondary suspension for connecting the body of the rail vehicle to the bogie frame, a rigid member having a first end and a second end, the first end having first means for coupling for coupling the rigid member to the vehicle body, the second end having second means for coupling for coupling the rigid member to the one of a drive unit and a brake unit substantially on the virtual pivot axis, each of the wheelset units having a console extending horizontally toward the center, means for interconnecting the consoles of at least two different ones of the wheelset units, at least one first pendulum having forward and rear ends, a first coupling on the forward end for connecting the forward end to the bogie frame, and a second coupling on the rear end for connecting the rear end to the console of one of the at least two different wheelset units.

According to yet another embodiment of the present invention, a bogie for a rail vehicle comprises: a bogie frame, wheelset units, each of the wheelset units including one of a drive unit and a brake unit, the one of the drive unit and the brake unit having a virtual pivot axis, a vertical line passing through the virtual pivot axis, a primary suspension connecting the wheelset unit to the bogie frame, the rail vehicle having a body, a secondary suspension for connecting the body of he rail vehicle to the bogie frame, a rigid member having a first end and a second end, the first end of the rigid member having first means for coupling the rigid member to the vehicle body, the second end of the rigid member having second means for coupling the rigid member to one of the drive unit and the brake unit of a first of the wheelset units at a point substantially on the vertical line passing through the virtual pivot axis, each of the wheelset units having an inside console extending substantially horizontally and substantially toward the center, means for interconnecting the inside consoles of at least two different wheelset units, at least one pendulum having first and second ends, a first pendulum coupling on the first end of the at least one pendulum for connecting the first end of the at least one pendulum to the bogie frame, and a second pendulum coupling on the second end of the at least one pendulum for connecting the second end of the pendulum to the console of one of the at least two different wheelset units.

According to yet another embodiment of the present invention, a bogie for a rail vehicle comprises: a bogie frame, wheelset units, each of the wheelset units including one of a drive unit and a brake unit, a primary suspension for connecting the wheelset units to the bogie frame, the rail vehicle having a body, a secondary suspension for connecting the body of the rail vehicle to the bogie frame, a rigid member having a first end and a second end, the first end of the rigid member having first means for coupling for cardanically coupling the rigid member to the vehicle body, the second end of the rigid member having second means for coupling for coupling the rigid member to one of the drive unit and the brake unit of a first of the wheelset units, the first of the wheelset units having a virtual pivot axis, the first means for coupling including means for coupling the rigid member at a point substantially on the virtual pivot axis, each of the wheelset units having an inside console extending substantially horizontally and substantially toward the center, means for interconnecting the inside consoles of at least two different wheelset units, at least one pendulum having first and second ends, a first pendulum coupling on the first end of the at least one pendulum for connecting the first end of the at least one pendulum to the bogie frame, and a second pendulum coupling on the second end of the at least one pendulum for connecting the second end of the at least one pendulum to the console of one of the at least two different wheelset units.

According to yet another embodiment of the present invention, a bogie for a rail vehicle comprises: a bogie frame, wheelset units, each of the wheelset units including one of a drive unit and a brake unit, a primary suspension for connecting the wheelset units to the bogie frame, the rail vehicle having a body, a secondary suspension for connecting the body of the rail vehicle to the bogie frame, a pair of rigid members each having a first end and a second end, the first end of each of the pair of rigid members having first means for coupling for cardanically coupling each of the pair of rigid members to the vehicle body, the second end of each of the pair of rigid members having second coupling means for coupling to one of the drive unit and the brake unit of a respective one of the wheelset units, each of the respective ones of the wheelset units having a virtual pivot axis, each of the first means for coupling including means for coupling a respective one of the pair of rigid members at a point substantially on the virtual pivot axis, each of the wheelset units having an inside console extending substantially horizontally and substantially toward the center, at least one pendulum having first and second ends, a first pendulum coupling on the first end of the at least one pendulum for connecting the first end of the at least one pendulum to the bogie frame, and a second pendulum coupling on the second end of the at least one pendulum for connecting the second end of the at least one pendulum to the console of one of the at least two different ones of the wheelset units.

The above, and other objects, features and advantages of the present invention will become apparent from the following description read in conjunction with the accompanying drawings, in which like reference numerals designate the same elements.

BRIEF DESCRIPTION OF THE DRAWINGS

Embodiments of the invention will now be described, by way of example only, with reference to the accompanying drawings.

DESCRIPTION OF THE PREFERRED EMBODIMENTS

Figure 1:
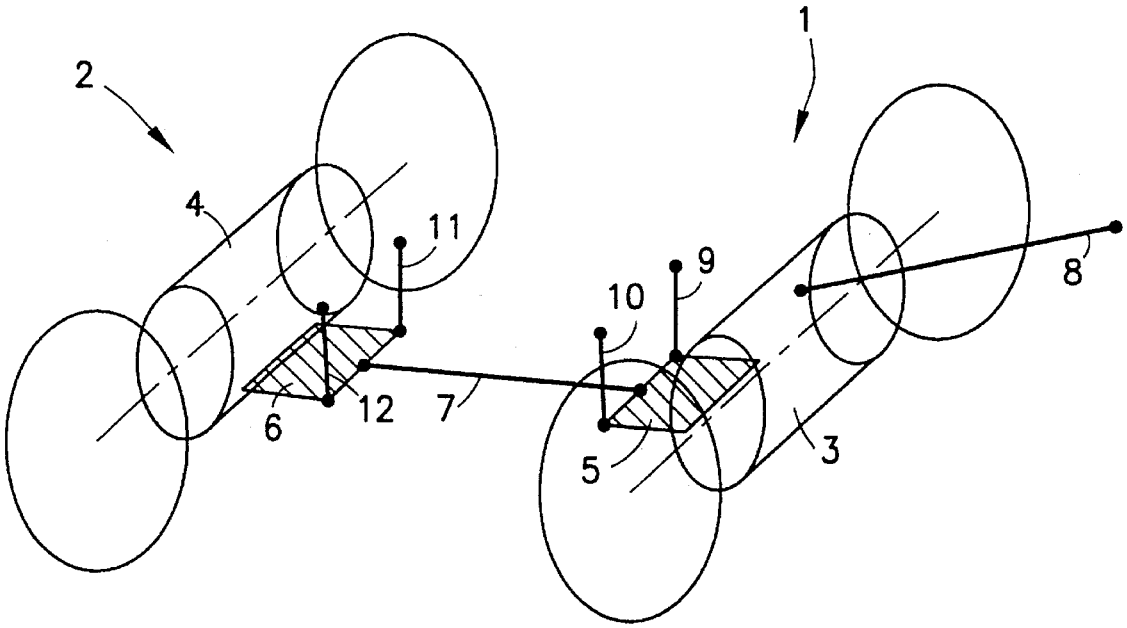
FIG. 1 is a schematic view of a bogie in which a guide rod is coupled to one of two wheelsets.

Referring to FIG. 1, a bogie comprises two wheelsets 1 and 2. Connected respectively to wheelsets 1 and 2 are drive units 3 and 4, which are in turn connected to each other via respective inward facing, i.e., mutually opposed, consoles 5 and 6 and a rigid connecting rod 7 for transferring tractional forces. A guide rod 8 is arranged between drive unit 3 and the vehicle body (not shown). For stabilization, drive units 3 and 4 are suspended on pendulums 9, 10, 11, 12 linked to consoles 5 and 6 and the bogie frame (not shown). All linkages are cardanic. The drive units, shown schematically in FIG. 1, can also be brake units, a combination of a drive unit and a brake unit, or a pair of combination drive/brake units.

Figure 2:
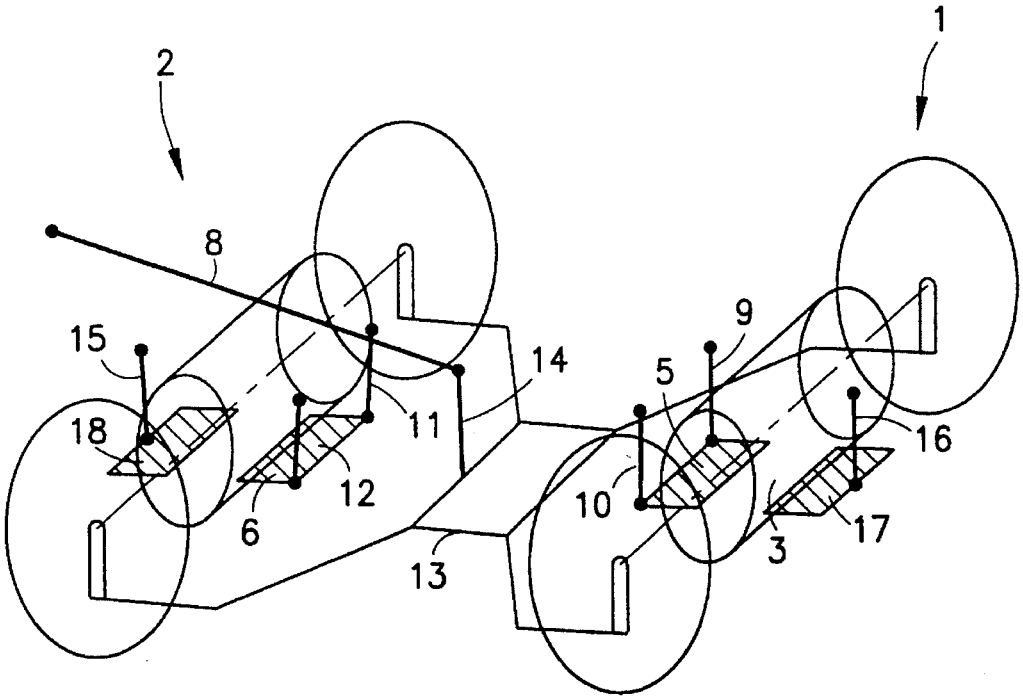
FIG. 2 is a schematic view of a bogie in which a guide rod is coupled to a coupling frame uniting all wheelset bearings.

Referring to FIG. 2, a bogie includes a coupling frame 13 that connects the wheelset bearings of wheelsets 1 and 2. Drive units 3 and 4 are provided respectively with inward-facing consoles 5 and 6 and outward-facing consoles 17 and 18. Drive units 3 and 4 are connected to the bogie frame (not shown) by pendulums 9, 10, 11, 12 linked to consoles 5 and 6 and pendulums 15 and 16 linked to consoles 17 and 18. Where the connections of the individual wheelset bearings converge, coupling frame 13 is provided with an upright link rod 14, to which guide rod 8, whose other end is connected to the vehicle body (not shown), is linked.

Figure 3:
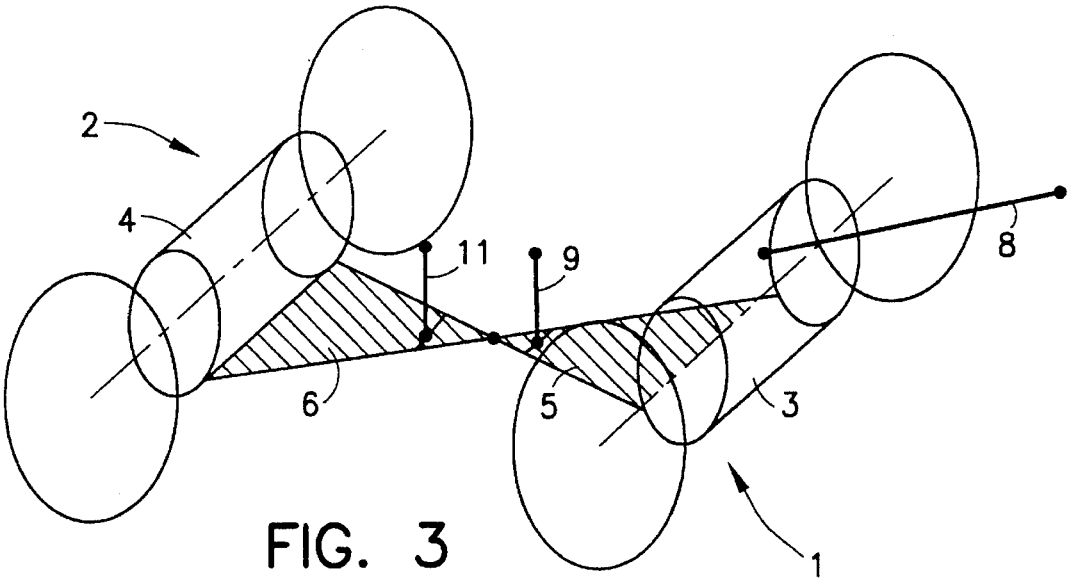
FIG. 3 is a schematic view of another embodiment of a bogie in which a guide rod is coupled to one of two wheelsets.

Referring to FIG. 3, in another embodiment, two wheelsets 1 and 2 have drive units 3 and 4 and inward-facing consoles 5 and 6. Consoles 5 and 6 are linked directly to each other so that no connecting rod is necessary to transfer the tractional forces. In this embodiment, only two pendulums 9 and 11 are provided between consoles 5 and 6 respectively and the bogie frame (not shown). Guide rod 8 is arranged between drive unit 3 of wheelset 1 and the vehicle body (not shown).

Figure 4:
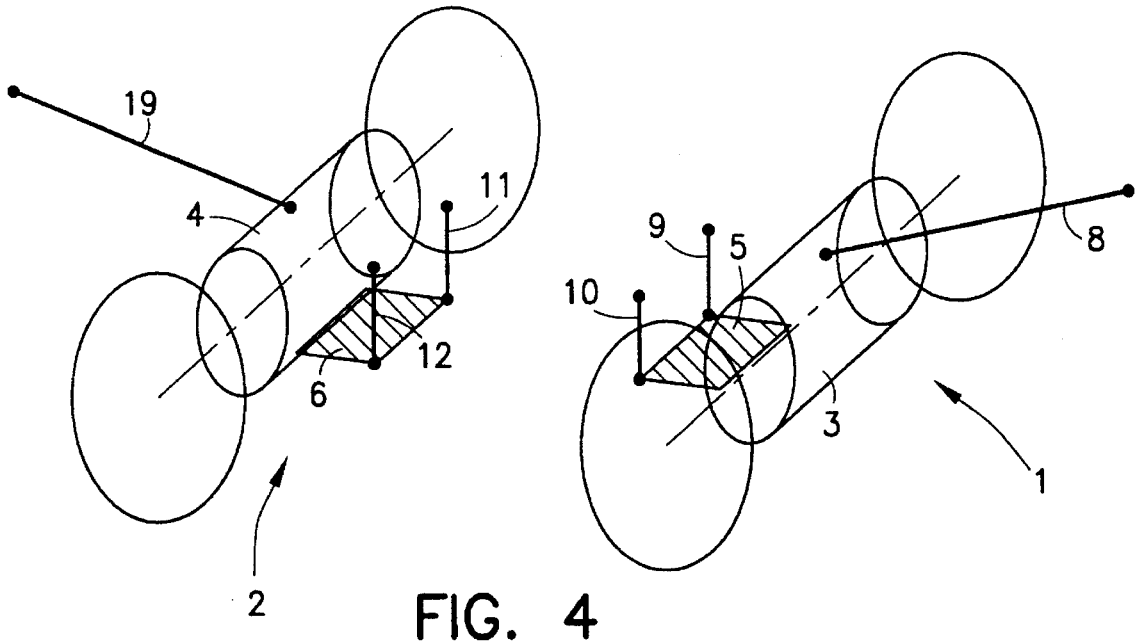
FIG. 4 is a schematic view of a bogie in which guide rods are coupled to respective ones of two wheelsets.

Referring to FIG. 4, another embodiment has two separate linkages. Two wheelsets 1 and 2, with respective drive units 3 and 4 and inward-facing consoles 5 and 6, and pendulums 9, 10, 11, and 12, between consoles 5 and 6 and the bogie frame (not shown), are not connected to each other. Since tractional forces are not transmitted directly between wheelsets 1 and 2, a pair of guide rods 8 and 19 connect drive units 3 and 4 respectively with the vehicle body (not shown). In the case of bogies in which only one wheelset is provided with a drive or brake unit, there would be—as in this embodiment—no connection between the two wheelsets and the guide rod on the non-driven or non-braked wheelset.

Figure 5:
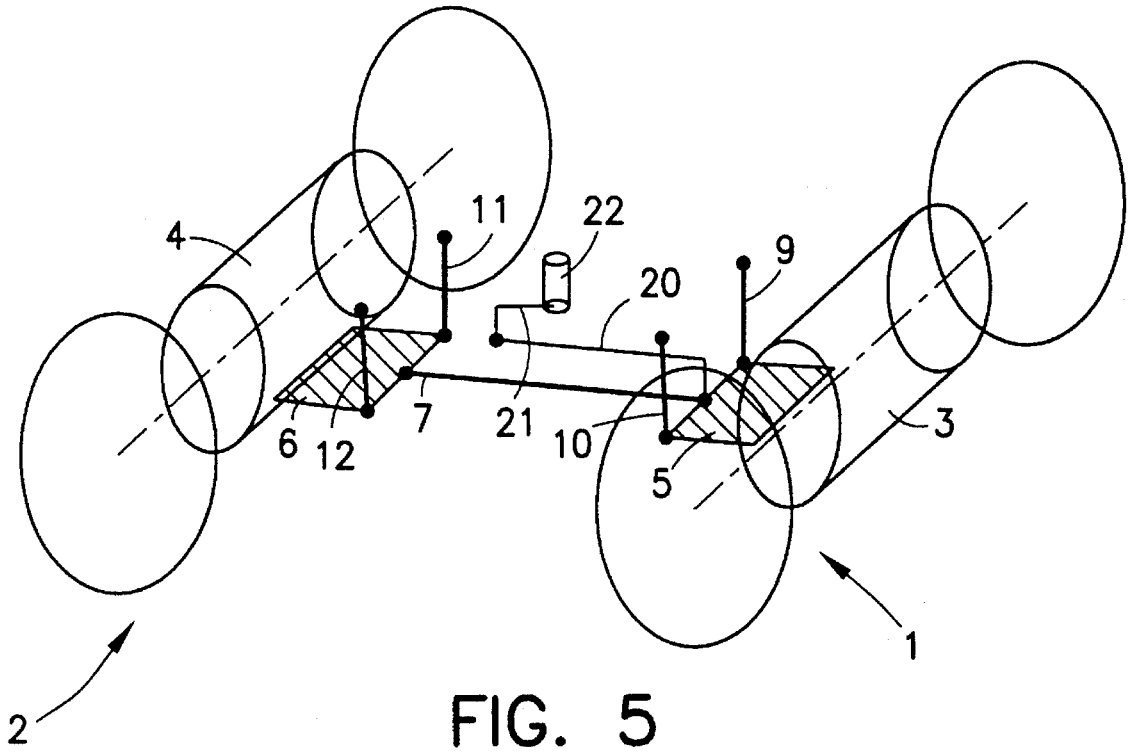
FIG. 5 is a schematic view of a bogie in which the guide rod is coupled between a console and a striker arm connected with a center pin.

Referring to FIG. 5, in another embodiment of the invention, the bogie has two wheelsets 1 and 2; provided respectively with drive units 3 and 4 and inward-facing consoles 5 and 6, to which pendulums 9, 10, 11 and 12 are linked and connected with the bogie frame (not shown). Consoles 5 and 6 are connected with each other via a connecting rod 7. A guide rod 20 is coupled at one end to console 5 of wheelset 1 and at the other end to a striker arm 21. Striker arm 21 is connected to a center pin 22 of the vehicle body (not shown).

Figure 6:
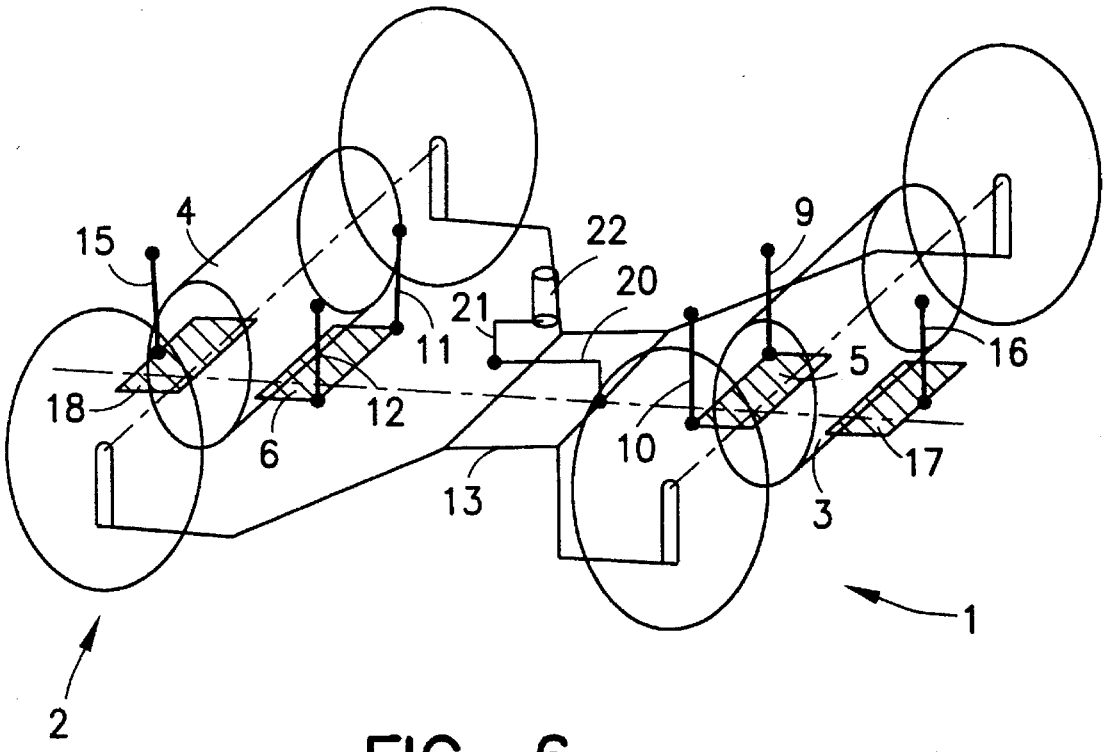
FIG. 6 is a schematic view of a bogie with a coupling frame in which a guide rod is coupled between the coupling frame and a striker arm connected with a center pin.

Referring to FIG. 6, another embodiment of a bogie is provided with a coupling frame 13, consoles 5, 6, 17, and 18, and pendulums 9, 10, 11 and 12, as described above with reference to FIG. 2. Guide rod 20 is linked at one end to coupling frame 13 where the connections to the individual wheelset bearings converge. At its other end, guide rod 20 is linked to striker arm 21 connected to center pin 22 of the vehicle body (not shown).

Figure 7:
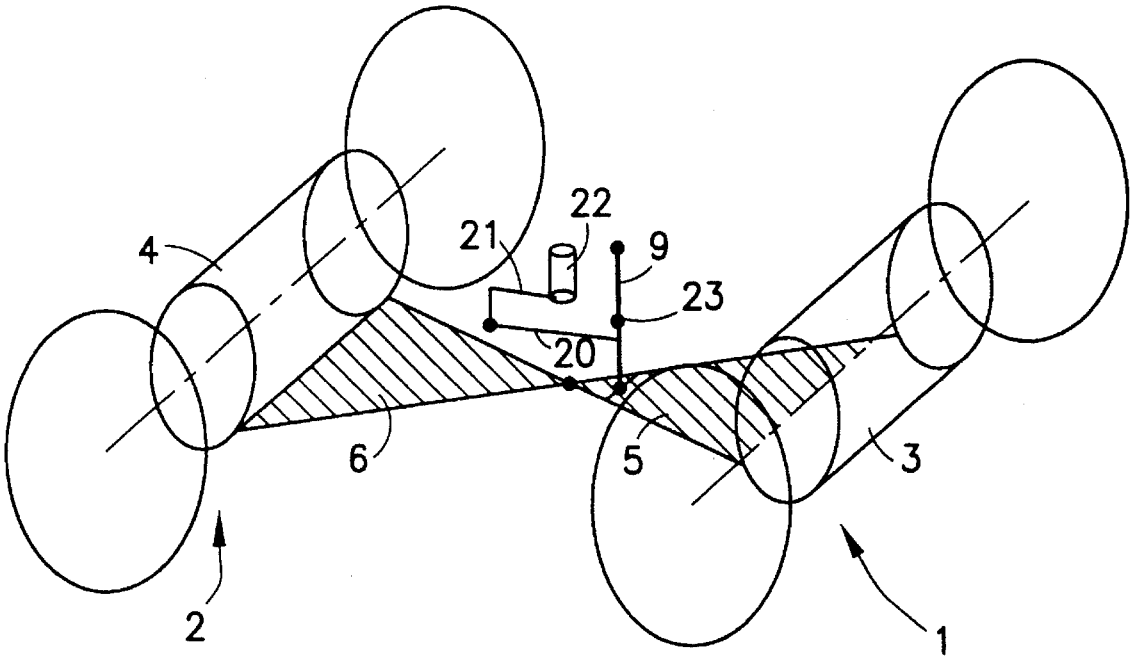
FIG. 7 is a schematic view of another embodiment of a bogie, in which a guide rod is arranged between a console and a striker arm connected with a center pin.

Referring to FIG. 7, a bogie with two wheelsets 1 and 2 has drive units 3 and 4 connected to each other by inward-facing consoles 5 and 6 respectively. Here guide rod 20 is linked at one end to console 5 and at its other end with striker arm 21, which engages center pin 22 of the vehicle body (Not shown). In this embodiment, the suspension of drive units 3 and 4 is accomplished via single pendulum 9 arranged between an upright extension 23 of guide rod 20 and the bogie frame (not shown).

Figure 8:
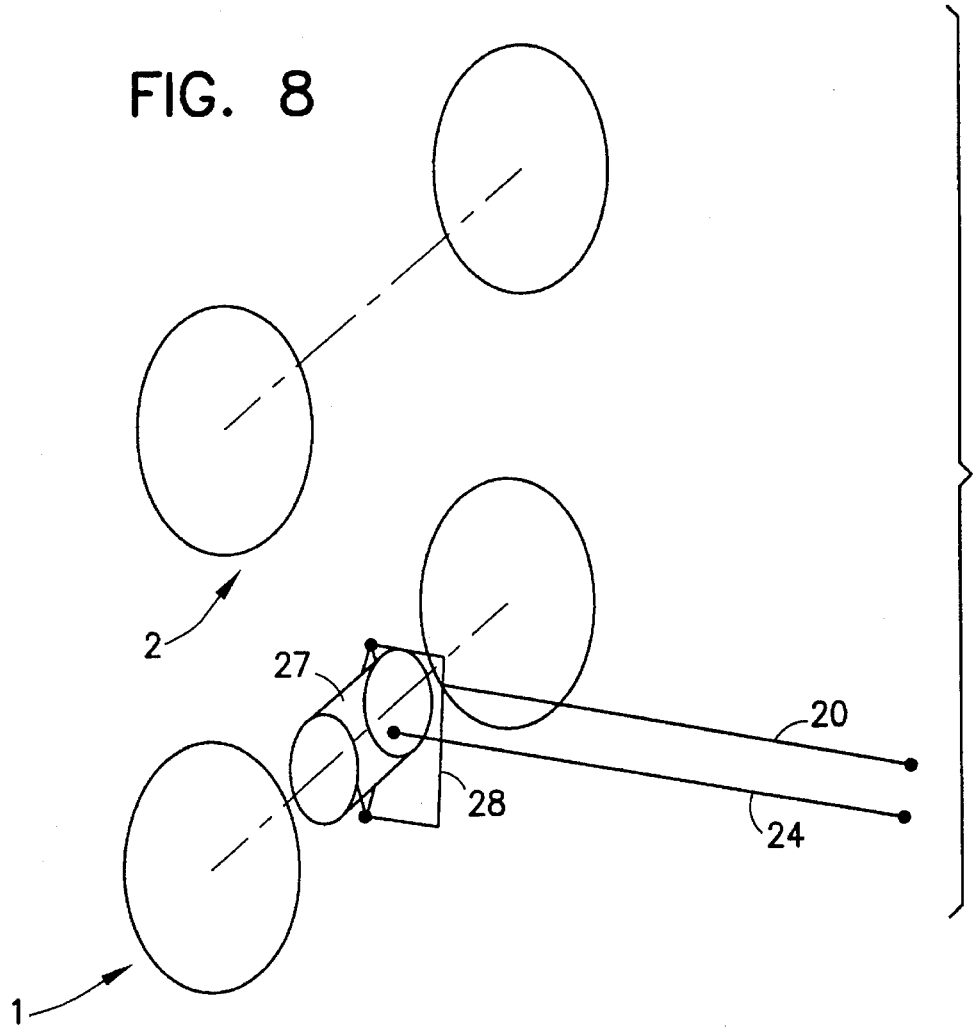
FIG. 8 is a schematic view of another embodiment of a bogie with a drive via a drive-shaft and a guide rod coupled to one wheelset.

Referring to FIG. 8, a bogie comprises two wheelsets 1 and 2. Wheelset 1 is driven by a drive shaft 24 and an axle drive 27. Guide rod 20 is linked to driven wheelset 1 and extends substantially parallel to drive shaft 24. Axle drive 27 is embraced castor-fashion above and below by a bifurcated extension 28 of guide rod 20, whereby guide rod 20 is linked above and below to axle drive 27, thus integrating the torque support for axle drive 27. At its other end, guide rod 20 is linked to the vehicle body (not shown).

Figure 9:
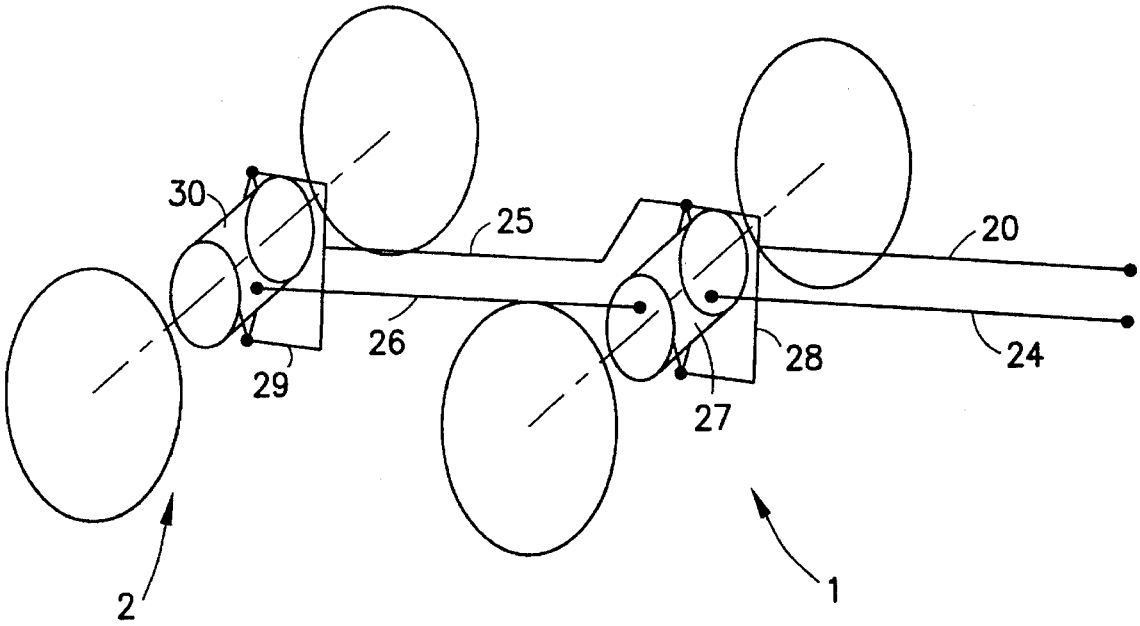
FIG. 9 is a schematic view of a bogie with a drive via drive shafts to two wheelsets and a guide rod coupled to one wheelset.

Referring to FIG. 9, the bogie of FIG. 8 now has second wheelset 2 also driven by a second drive shaft 26 arranged between axle drive 27 of wheelset 1 and an axle drive 30 of wheelset 2. Guide rod 20 is connected to axle drive 27 of first wheelset 1 as illustrated in FIG. 8. A connecting rod 25, extending between axle drive 27 of first wheelset 1 and axle drive 30 of second wheelset 2, transfers the tractional forces. A bifurcated extension 29 of connecting rod 25 embraces second axle drive 30 in like manner to that illustrated in FIG. 8 for guide rod 28.

Figure 10:
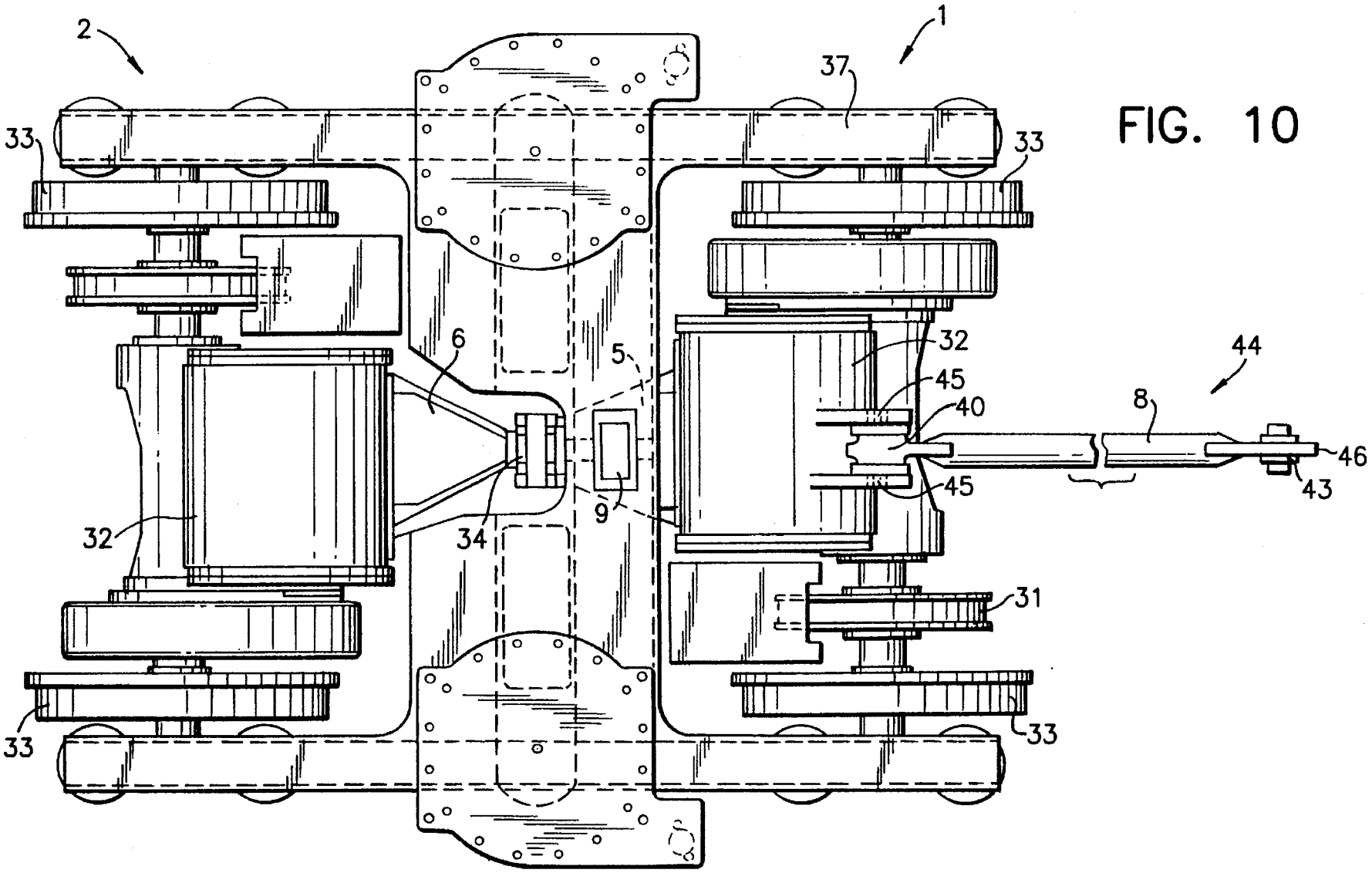
FIG. 10 is a top view of the embodiment or a bogie according to FIG. 3.
Figure 11:
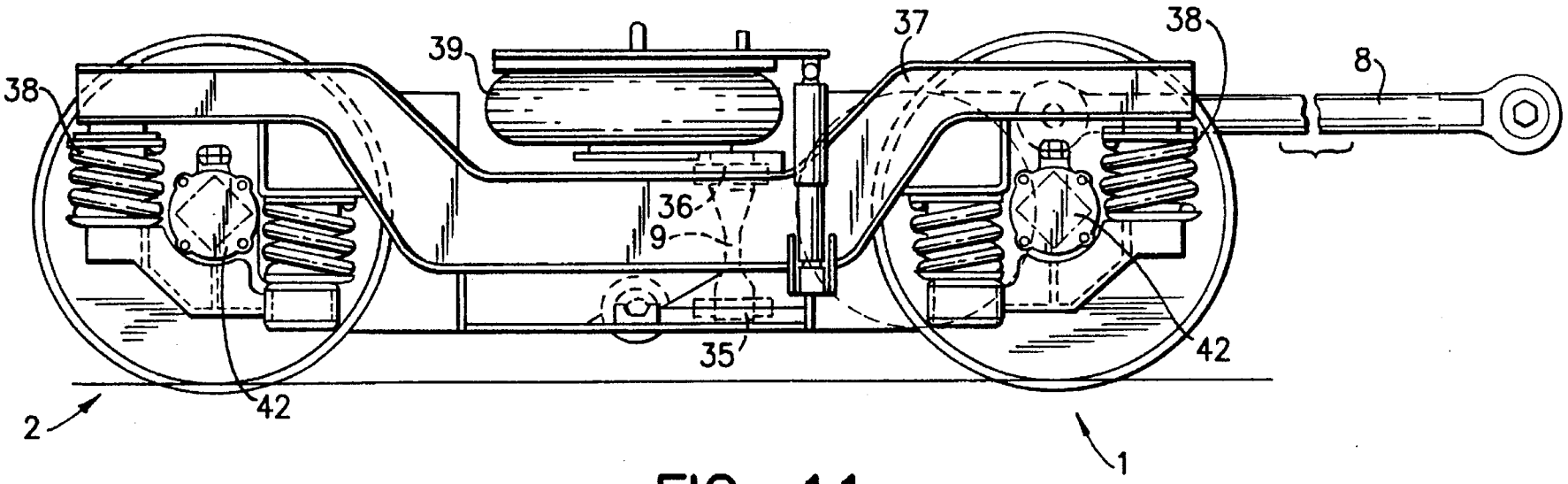
FIG. 11 is a lateral view of the bogie according to FIG. 10.

Referring to FIGS. 10 and 11, the bogie of FIG. 3 with only single pendulum 9 has two wheelsets 1 and 2, each with wheels 33. Wheelsets 1 and 2 are connected to a bogie frame 37 via wheelset bearings 42 and primary springs 38. Also between bogie frame 37 and the vehicle body (not shown) are secondary springs 39. Both wheelsets 1 and 2 are provided with drive units, namely, axle-mounted motors 32, and brake units 31. On their housings, axle-mounted motors 32 are provided with consoles 5 and 6 respectively. Consoles 5 and 6 face toward the middle of the bogie and are connected to each other via a cardanic coupling 34. Console 5 has a cardanic linkage 35 to which pendulum 9 is linked. At its other end, pendulum 9 is linked to bogie frame 37 via a cardanic linkage 36. Finally, guide rod 8 is connected at one end to axle-mounted motor 32 of first wheelset 1 via a cardanic joint 40 and at its other end to the vehicle body (not shown) via a cardanic joint 43. That is how tractional forces are transferred directly to the vehicle body by wheelsets 1 and 2 via consoles 5 and 6 (connecting wheelsets 1 and 2 to each other) or via guide rod 8. This configuration permits the adjusting behavior of the wheelsets to be determined solely by the forces of the wheel/track geometry, while the bogie frame performs only "carrying" and "guiding" functions.

What is claimed is:

1. A bogie for a rail vehicle with a body, comprising:

a bogie frame having a center;

wheelset units;

at least one of said wheelset units having at least one of a drive unit and a brake unit;

a primary suspension for connecting said wheelset units to said bogie frame;

a secondary suspension for connecting said body to said bogie frame;

a rigid member having a first end and a second end:

said first end having first means for coupling said rigid member to said body;

each of said wheelset units having a console extending horizontally toward said center;

said second end having second means for coupling said rigid member to at least one of said consoles;

means for movably interconnecting a first position on a first of said consoles and a second position on a second of said consoles;

a pendulum having first and second ends;

said first end being connected to said bogie frame;

said second end being connected to said first of said consoles at a second position of said first of said consoles;

said second position being remote from a vertical line passing through said first position.

2. Apparatus as in claim 1, wherein said means for interconnecting includes a rigid rod.

3. Apparatus as in claim 2, wherein:

said rigid rod has a front end and a back end; and one of said front end and said back end includes a cardanic coupling for connecting one of said front end and said back end to one of said at least two of said consoles.

4. Apparatus as in claim 2, wherein said rigid rod includes means for transmitting tractional forces between said at least two of said consoles.

5. Apparatus as in claim 4, wherein said means for interconnecting includes a cardanic coupling between said at least two of said consoles.

6. Apparatus as in claim 5, wherein said means for interconnecting includes a second cardanic coupling between said at least two of said consoles.

7. Apparatus as in claim 4, wherein said means for interconnecting includes means for transmitting tractional forces between said at least two of said consoles.

8. Apparatus as in claim 1, wherein said means for interconnecting includes a cardanic coupling between said at least two of said consoles.

9. Apparatus as in claim 1, wherein said means for interconnecting includes means for transmitting tractional forces between said at least two of said consoles.

10. A bogie for a rail vehicle with a body, comprising:

a bogie frame having a center;

wheelset units;

at least one of said wheelset units including at least one of a drive unit and a brake unit;

a primary suspension for connecting said wheelset units to said bogie frame; said primary suspension having means for permitting said wheelset units to rotate about respective virtual centers of rotation;

a secondary suspension for connecting said body of said rail vehicle to said bogie frame;

a rigid member having a first end and a second end;

said first end having body-coupling means for coupling said rigid member to said vehicle body;

said second end having wheelset-coupling means for coupling said rigid member to said one of a drive unit and a brake unit;

each of said wheelset units having a console extending horizontally toward said center;

means for interconnecting said consoles of at least two different ones of said wheelset units:

at least one first pendulum having upper and lower ends:

a first coupling on said upper end for connecting said upper end to said bogie frame; and a second coupling on said lower end for connecting said lower end to said console of a one of said at least two different wheelset units:

said second coupling including means for permitting pivoting movement of said pendulum with respect to said console of said one;

said rigid member being coupled to said one of a drive unit and a brake unit substantially on said virtual center of rotation;

said means for interconnecting including a member flexibly connected to said console at a position of said console substantially remote from a vertical line passing through said lower end.

11. Apparatus as in claim 10, wherein:

said first coupling includes a first cardanic joint; and said second coupling includes a second cardanic joint.

12. Apparatus as in claim 10, wherein said body-coupling means includes a cardanic joint.

13. Apparatus as in claim 10, wherein said wheelset-coupling means includes a cardanic joint.

14. Apparatus as in claim 13 wherein said body-coupling means includes a cardanic joint.

15. Apparatus as in claim 14, wherein said rigid member extends horizontally in a direction of travel of said bogie.

16. Apparatus as in claim 14, wherein said rigid member includes means for transmitting traction forces between said one of a drive unit and a brake unit and said vehicle body.

17. Apparatus as in claim 10, further comprising:

at least one second pendulum having an elevated end and a depressed end;

a third coupling on said elevated end for connecting said elevated end to said bogie frame; and a fourth coupling on said depressed end for connecting said depressed end to said console of another of said at least two different ones of said wheelset units.

18. Apparatus as in claim 17, wherein:

said third coupling includes a first cardanic joint; and said fourth coupling includes a second cardanic joint.

19. Apparatus as in claim 18, wherein said means for interconnecting includes a third cardanic joint.

20. Apparatus as in claim 10, wherein said means interconnecting includes:

a connecting member having a front end and a rear end;

said front end having front coupling means for coupling said connecting member to said console of a first of said at least two different ones of said wheelset units;

said rear end of said connecting member having rear coupling means for coupling said connecting member to said console of a second of said at least two different ones of said wheelset units.

21. Apparatus as in claim 20, wherein:

said front coupling means includes a first cardanic joint; and said rear coupling means includes a second cardanic joint.

22. Apparatus as in claim 21, wherein said means for interconnecting includes:

a connecting member having a first end and a second end;

said first end of said connecting member having third coupling means for coupling said connecting member to said console of a first of said at least two different wheelset units;

said second end of said connecting member having fourth coupling means for coupling said connecting member to said console of a second of said at least two different wheelset units.

23. Apparatus as in claim 22, wherein:

said third coupling means includes a first cardanic joint; and said fourth coupling means includes a second cardanic joint.

24. A bogie for a rail vehicle with a body, comprising:

a bogie frame;

wheelset units;

each of said wheelset units including at least one of a drive unit and a brake unit:

a primary suspension for connecting said wheelset units to said bogie frame;

a secondary suspension :for connecting said body of said rail vehicle to said bogie frame;

a rigid member having a first end and a second end:

said first end of said rigid member having first means for coupling said rigid member to said vehicle body;

said second end of said rigid member having second means for coupling said rigid member to said at least one of a drive unit and a brake unit of a first of said wheelset units at a first point of said first of said first of said wheelset units;

each of said wheelset units having an inside console extending substantially horizontally and substantially toward said center:

means for interconnecting said inside consoles of at least: two different ones of said wheelset units;

said means for interconnecting including a flexible coupling connected at a connection point on each of said inside consoles:

at least one pendulum having first and second ends:

a first pendulum coupling on said first end of said at least one pendulum for connecting said first end of said at least one pendulum to said bogie frame; and a second pendulum coupling on said second end of said at least one pendulum for connecting said second end of said pendulum to said console one of said at least two different ones of said wheelset units at a pendulum-coupling point on said one;

said first and second pendulum couplings including means for permitting said console of said one to pivot about a substantially vertical axis that intersects said console of said one substantially at said first point of said first of said wheelset units;

said connection point being substantially remote from a vertical line passing through said pendulum-coupling point.

25. Apparatus as in claim 24, wherein said means for interconnecting includes a cardanic joint for directly coupling cardanically a first of said inside consoles of said two different ones of said wheelset units to a second of said inside consoles of said two different ones of said wheelset units.

26. A bogie for a rail vehicle with a body, comprising:

a bogie frame;

wheelset units;

each of said wheelset units including at least one of a drive unit and a brake unit;

a primary suspension for connecting said wheelset units to said bogie frame;

a secondary suspension for connecting said body of said rail vehicle to said bogie frame;

a rigid member having a first end and a second end;

said first end of said rigid member having body-coupling means for cardanically coupling said rigid member to said vehicle body;

said second end of said rigid member having wheelset-coupling means for coupling said rigid member to said one of a drive unit and a brake unit of a first of said wheelset units;

said first of said wheelset units having a virtual center of rotation;

said wheelset-coupling means including means for coupling said rigid member at a point substantially on said virtual center of rotation;

each of said wheelset units having an inside console extending substantially horizontally and substantially toward said center;

means for interconnecting said inside consoles of at least two different ones of said wheelset units:

said means for interconnecting including a flexible connector located at a connecting point on said console of one of said at least two different ones of said wheelset units;

at least one pendulum having first and second ends:

a first pendulum coupling on said first end of said at least one pendulum for connecting said first end of said at least one pendulum to said bogie frame; and a second pendulum coupling on said second end of said at least one pendulum for connecting said second end of said at least one pendulum to said console of said one of said at least two different ones of said wheelset units at a pendulum-coupling position remote from said connecting point;

said first and second pendulum couplings including means for permitting said console of said one to rotate about said virtual center of rotation.

27. Apparatus as in claim 26, wherein said rigid member extends horizontally in a direction of travel of said bogie.

28. Apparatus as in claim 26, wherein said rigid member includes means for transmitting traction forces between said at least one of a drive unit and a brake unit and said vehicle body.

29. A bogie for a rail vehicle with a body, comprising:

a bogie frame;

wheelset units;

at least one of said wheelset units having at least one of a drive unit and a brake unit;

a primary suspension for connecting said wheelset units to said bogie frame;

a secondary suspension for connecting said body to said bogie frame;

means for transferring tractional forces between said wheelset units;

said means for transferring including a rigid member coupled to said wheelset units;

said rigid member being movably coupled to a first point on a first of said wheelset units to permit said rigid member to pivot with respect to said first of said wheelset units about at least a vertical axis passing through said first point;

said wheelset units being coupled to said bogie frame by a suspension means that permits said wheelset units to rotate, with respect to said bogie frame, around respective virtual centers of rotation of said wheelset units to adjust to a curved track; and said suspension means including at least one pendulum pivotally linked at an end thereof to said first of said wheelset units at a point remote from said vertical axis and at a further end thereof to said bogie frame.

30. A bogie for a rail vehicle having a body, comprising:

wheelset units, each having an axle;

a bogie frame;

each of said wheelset units being rotatably connected to said bogie frame by a primary suspension;

said primary suspensions having means to allow respective said wheelset units to pivot around respective virtual centers of rotation in relation to said bogie frame;

said bogie frame movably connected to said body by a secondary suspension;

at least one of said wheelset units having a drive means for exerting a rotational force to said axle;

each of said drive means having a console rigidly connected to said drive means:

at least one pendulum, for said at least console;

said at least one pendulum having first and second ends;

said first end being, pivotably linked at a first point of said console of a first of said wheelsets and pivotably linked at said second end to said bogie frame said console of said first of said wheelsets being pivotably linked to a second of said wheelsets at a second point of said console of said first of said wheelsets;

said first point being a substantial horizontal distance from said second point; and means, connected to said wheelset units, for self-adjusting an alignment, of said wheelset units, about said virtual centers of rotation to accommodate straight or curved rail for tracking a path along said rail.

31. A bogie for a rail vehicle having a body, comprising:

wheelset units, each having an axle;

a bogie frame;

each of said wheelset units being rotatably connected to said bogie frame by a primary suspension;

said each of said wheelset units being pivotably connected to another of said wheelset units at a first point of said each of said wheelset units;

said primary suspensions having means to allow respective said wheelset units to pivot around respective virtual centers of rotation in relation to said bogie frame;

said primary suspension including at least one pendulum having first and second ends;

said first end being connected to said bogie frame;

said second end being connected to said one of said wheelset units at a second point of said one of said wheelset units;

said second point being a horizontal distance from said first point;

said bogie frame movably connected to said body by a secondary suspension;

at least one of said wheelset units having a drive means for exerting a rotational force to said axle; and said primary suspension including means, for self-adjusting an alignment, of said wheelset units about said virtual axes to accommodate straight or curved rail for tracking a path along said rail.

32. Apparatus as in claim 31 further comprising a means for transferring tractional forces between said wheelset units and said rail vehicle.

33. Apparatus as in claim 32 wherein said means for transferring tractional forces is a guide rod connecting at least one of said drive means to said rail vehicle.

* * * * *